United States Patent [19]

Frantz

[11] 4,131,457

[45] Dec. 26, 1978

[54] HIGH-STRENGTH, HIGH-EXPANSION MANGANESE ALLOY

[75] Inventor: Earl L. Frantz, Reading, Pa.

[73] Assignee: Carpenter Technology Corporation, Reading, Pa.

[21] Appl. No.: 840,799

[22] Filed: Oct. 11, 1977

[51] Int. Cl.[2] ..... C22C 22/00

[52] U.S. Cl. ..... 75/134 M; 148/32

[58] Field of Search ..... 75/134 M; 148/32

[56] References Cited

U.S. PATENT DOCUMENTS 3,977,868 8/1976 Nakae et al. ..... 75/134 M

*Primary Examiner*—R. Dean

*Attorney, Agent, or Firm*—Edgar N. Jay

[57] ABSTRACT

An alloy, and shaped articles made therefrom, having high thermal expansion and/or high electrical resistivity with enhanced mechanical strength containing

| | w/o |
|---|---|
| Copper | 5-30 |
| Nickel | 5-30 |
| Nitrogen | 0.1-1.0 |

the balance at least 65 – <85% manganese and varying amounts of other elements such as one or more of the elements C, Si, P, S, Mo, Co, Ti, V, Nb, Ta, Fe, Hf, Zr, B and Be which do not objectionably detract from the desired properties.

23 Claims, No Drawings

HIGH-STRENGTH, HIGH-EXPANSION MANGANESE ALLOY

BACKGROUND

This invention relates to high-expansion manganese alloys and, more particularly, to a high-expansion manganese-copper-nickel alloy having improved strength and electrical resistivity and shaped articles made therefrom.

High-expansion manganese alloys containing copper and nickel have long been provided for a wide variety of uses, as for example, bimetal strip in thermally responsive control device. For example, Dean and Anderson U.S. Pat. No. 2,234,748, Mar. 11, 1941, discloses an alloy containing 50 to 85% manganese, 2 to 48% copper, and 2 to 35% nickel with the sum of the Mn, Cu and Ni being substantially 100%. Specific compositions contain 75% Mn with 5% Ni and 20% Cu, with 10% Ni and 15% Cu, with 15% Ni and 10% Cu, and with 20% Ni and 5% Cu. The compositions, when treated as described are asserted to have a temperature coefficient of expansion of from about 24.5 to as high as $27.0\times10^{-6}/°$ C. Dean U.S. Pat. No. 2,317,979, May 4, 1943, relates to Mn—Ni—Zn—Cu alloys and sets forth a composition containing 72% Mn, 18% Cu and 10% Ni.

Dean U.S. Pat. No. 2,329,698, Sept. 21, 1943 relates to the preparation of manganese alloys by means of powder metallurgy techniques in which powdered electrolytic manganese is mixed with powdered copper and heated in the absence of oxygen and nitrogen to achieve diffusion of the copper into the manganese. When copper cannot be tolerated, other procedures for obtaining ductile manganese powder include using nickel in place of copper or heating the manganese in ammonia gas at about 450° C. and then, in the absence of oxygen or in an atmosphere of nitrogen, to a temperature of about 1000° C.

Averbach, *Metals and Alloys*, July 1941 pp. 47–51, at page 49 lists a large number of Mn, Cu, Ni alloys including 80% Mn, 10% Cu, 10% Ni and points out some of the effects of composition variations of those three elements.

Gottlieb et al U.S. Pat. No. 3,765,846, Oct. 16, 1973 relates to thermostatic bimetals in which the high-expansion material contains 15.5–22.5% nickel, an amount of copper such that the sum of the percent copper and one-half the percent nickel is 13.75–16.75% and the balance manganese. In effect, the copper content can vary from 2.5–9.0% and the manganese content from about 68.5–82% (with incidental impurities). The preferred compositions are identified as those containing 15.5–18.5% nickel which results in a corresponding copper content of 4.50–9.00%. British Patent No. 526,093 (Consolidated Mining and Smelting Company of Canada, Ltd.) 1940, relates to alloys of Mn and Cu containing at least 40% Mn and one or more of the elements Ni, B, Al, Sn, Ag, Si and Be all added to the pure manganese for the purpose of providing ductile alloys, pure manganese alone being brittle. A composition containing 80% Mn also contains 10% Cu, 10% Ni and 0.02% B.

Thus, it has long been recognized in connection with the ternary system Mn—Cu—Ni that variations in the proportions of the elements have a significant effect on the alloys' thermal expansivity and electrical resistivity. However, such manganese alloys containing copper and nickel with or without relatively small amounts of additional elements have hitherto been difficult to control so as to ensure in a shaped article the desired high-thermal expansion and other desired properties.

BRIEF SUMMARY

It is, therefore, a principal object of this invention to provide a manganese alloy containing copper and nickel with or without relatively small amounts of additional alloying elements which provides a unique combination of high mechanical strength with high thermal expansion and/or high resistivity.

A further object of this invention is to provide shaped articles made from such an alloy having a unique combination of high mechanical strength with high thermal expansion and/or high resistivity.

Broadly stated, in accordance with the present invention, an alloy is provided which, in weight percent (w/o), comprises about

| | w/o |
|---|---|
| Copper | 5–30 |
| Nickel | 5–30 |
| Nitrogen | 0.1–1.0 |

with the balance from at least 65% to less than 85% or to about 80% manganese and incidental impurities. Varying amounts of other elements such as one or more of the elements C, Si, P, S, Mo, Co, Ti, V, Nb, Ta, Fe, Hf, Zr, B and Be in amounts which do not objectionably detract from the desired properties may also be present. Desirably, no more than about 0.04% phosphorus, about 0.04% sulfur, about 0.5% carbon and about 0.5% silicon should be present. It is to be noted that though the present invention contemplates as much as up to but less than 85% manganese, it is intended to exclude those compositions in which the amount of manganese in excess of 80% and the balance of the remaining elements is such as to lead to the presence of unwanted face-centered tetragonal gamma phase in articles formed from the composition.

DETAILED DESCRIPTION

Manganese is the major constituent of the alloy of this invention and should be present in an amount of at least about 65% because as manganese is reduced below that amount, the accompanying loss in ductility becomes unacceptable. Increasing manganese up to 80.0% works with the copper and nickel, as will be described hereinbelow, to increase the composition's coefficient of thermal expansion. However, unless the desired face-centered cubic gamma phase is stabilized as in accordance with the present invention by the addition of nitrogen, the larger amounts of manganese above 75% to less than 85% lead to the presence of the unwanted face-centered tetragonal gamma phase with a loss in expansivity which also may be accompanied by brittleness. As the manganese content is increased above 80.0%, some drop in expansivity is to be expected and, therefore, manganese is preferably limited to no more than 82%.

Copper is required to provide the desired ductility and may be present in an amount from 5–30%. Preferably, copper is present in an amount equal to or greater than the amount of nickel present when manganese is greater than about 75%. In the case of the lower amounts of manganese, the copper-nickel ratio should be less than 1.

Nickel works to stabilize the desired face-centered gamma structure and ensure that the coefficient of thermal expansion does not fall below a desired level. For best combination of structural stability and coefficient of expansion, the amount of nickel should be greater than or less than the amount of copper present depending upon whether the manganese content is less than or greater than about 75%.

The unique combination of properties characteristic of the composition of this invention is achieved by a critical nitrogen addition of 0.1% or, better yet, 0.25% to about 0.9% or up to 1.0% and preferably up to 0.6% but, in any event, the nitrogen present should substantially be retained in solid solution in the composition. The larger amounts of nitrogen are used with and can be retained in solution with the larger amounts of manganese. Because of its adverse effect upon ductility, larger amounts of nitrogen than 1.0% are not desirable, and, for better cold rollability, the lower amounts of nitrogen within the stated range of 0.1–0.9% are used. Nitrogen in solid solution in this composition within the stated range is believed to work both as a solid solution strengthener and to stabilize the desired face-centered cubic gamma phase against transformation to the unwanted face-centered tetragonal gamma phase after having been mechanically stressed and works to delay the appearance of face-centered tetragonal phase which otherwise would occur with increasing manganese above about 80%. To maximize its strengthening effect, preferably at least about 0.5% nitrogen is used in solid solution. Nitrogen also works to provide increased electrical resistivity up to as much as 15% or more. While the broad range of nitrogen is 0.1–1.0% and 0.25% has been indicated as a preferred minimum and a minimum of about 0.5% nitrogen is preferred to ensure maximum strength without cold working, it is to be understood it is intended that any one of those values be used with any of the broad or preferred limits of each or all of the remaining elements. The same is intended to apply to the larger amounts of 0.9% and 1.0% nitrogen.

The enhanced strength of this composition, particularly with the larger amounts of nitrogen, i.e. about 0.5% or more, makes it suitable for use in its fully annealed condition as the high expansion component of a temperature responsive bimetallic control element. Prior compositions which do not contain the critical nitrogen addition of this invention and which are cold rolled to attain the required strength, are susceptible to stress corrosion cracking even in mildly corrosive media such as water, humid environments, ammonia and acidic environments as well as others. On the other hand, because of its improved strength, the material of the present invention can be used in its fully annealed condition, in which condition it is expected to have significantly reduced susceptibility to stress corrosion cracking when exposed in use to the same media or environments.

Examples 1–5, illustrative of the present invention, have the composition, in weight percent, indicated in Table I except for incidental impurities of up to about one or two tenths of a percent which included less than 0.01% carbon, up to 0.01% silicon, up to 0.01% phosphorus, up to 0.02% sulfur, up to 0.1% chromium, up to 0.01% molybdenum (Examples 1–3) and less than about 0.1% iron.

TABLE I

| | Ex. 1 | Ex. 2 | Ex. 3 | Ex. 4 | Ex. 5 |
|---|---|---|---|---|---|
| Mn | 80.08 | 79.99 | 81.15 | 78.42 | 73.04 |
| Ni | 9.72 | 9.83 | 9.24 | 11.63 | 9.20 |
| Cu | 9.84 | 9.75 | 9.11 | 9.18 | 17.56 |
| N | 0.25 | 0.51 | 0.95 | 0.76 | 0.26 |

Examples 1–5 were prepared from small, about 2⅜ inch square, (6 cm sq.), ingots cast from small vacuum induction heats. The ingots were forged and hot rolled from a furnace temperature of 1600° F. (870° C.) to 1¼ inch × ½ inch (3.2 cm × 1.3 cm) thick which, after surface preparation, were then cold rolled to 0.250 inch thick (6.35 mm), about a 50% reduction. In the case of Examples 1–3 and 5, test specimens for thermal expansion measurements were prepared for some of this material. Coupons for X-ray diffraction analyses were also prepared in the case of Examples 1–3. The thermal expansion tests and X-ray diffraction analyses were made on specimens both as cold rolled (about 50%) and also after annealing at 1500° F. (815° C.) for ½ hour. The results of thermal expansion measurements are given in Table II. No face-centered tetragonal phase was found in the cold rolled or annealed specimens of Examples 1–3 which were all face-centered cubic gamma phase.

TABLE II

| | Thermal Expansion Coefficient, $10^{-6}$/° F ($10^{-6}$/° C) [from 75° F (24° C) to indicated temperature] | | | | | | | |
|---|---|---|---|---|---|---|---|---|
| | Cold Rolled (50%) | | | | Annealed | | | |
| Ex. No. | 200° F (93° C) | 300° F (150° C) | 500° F (260° C) | 700° F (370° C) | 200° F (93° C) | 300° F (150° C) | 500° F (260° C) | 700° F (370° C) |
| 1 | 14.18 (25.52) | 14.77 (26.59) | 16.26 (29.27) | 17.29 (31.12) | 15.94 (28.69) | 16.35 (29.43) | 17.47 31.45) | 18.25 (32.85) |
| 2 | 14.13 (25.43) | 14.51 (26.12) | 15.72 (28.30) | 16.62 (29.92) | 15.18 (27.32) | 15.85 (28.53) | 17.00 (30.60) | 17.80 (32.04) |
| 3 | 13.94 (25.09) | 14.54 (26.17) | 15.79 (28.42) | 16.75 (30.15) | 14.08 (25.34) | 15.04 (27.07) | 16.43 (29.57) | 17.36 (31.25) |
| 5 | 4.28 (25.70) | 15.36 (27.65) | 15.92 (28.66) | 16.39 (29.50) | 14.07 (25.33) | 15.15 (27.27) | 15.84 (28.51) | 16.39 (29.50) |

For comparison, Alloys A and B were prepared representative of prior art compositions corresponding in the case of Alloy A to Examples 1–3 but containing only 0.018% nitrogen and, in the case of Alloy B, corresponding to Example 5 but containing only 0.019% nitrogen. More specifically, the composition of Alloys A and B is given in Table III except for incidental impurities which were essentially as previously described in connection with Examples 1–5.

TABLE III

| Alloy | Mn | Ni | Cu | N |
|---|---|---|---|---|
| A | 79.21 | 10.15 | 10.35 | .018 |
| B | 72.66 | 9.66 | 17.46 | .019 |

Ingots were prepared from Alloys A and B, and test specimens were prepared therefrom as was described in connection with Examples 1–5. X-ray diffraction analysis of Alloy A showed the presence of face-centered tetragonal gamma phase in the cold rolled material of Alloy A. The results of the thermal expansion measurements made using specimens of Alloys A and B, which specimens and measurements were prepared and carried out as described in connection with Examples 1-5, are given in Table IV.

TABLE IV

| Alloy | Thermal Expansion Coefficient, $10^{-6}$/° F ($10^{-6}$/° C) [from 75° F (24° C) to indicated temperature] Cold Rolled (50%) 200° F (93° C) | 300° F (150° C) | 500° F (260° C) | 700° F (370° C) | Annealed 200° F (93° C) | 300° F (150° C) | 500° F (260° C) | 700° F (370° C) |
|---|---|---|---|---|---|---|---|---|
| A | 13.70 (24.66) | 14.32 (25.78) | 15.73 (28.31) | 17.02 (30.64) | 16.84 (30.31) | 16.98 (30.56) | 17.98 (32.36) | 18.53 (33.35) |
| B | 14.20 (25.56) | 14.85 (26.73) | 15.56 (28.01) | 16.30 (29.34) | 14.12 (25.42) | 14.97 (26.95) | 15.67 (28.21) | 16.28 (29.30) |

A comparison of the data in Tables II and IV shows essentially no change in thermal expansion coefficient in the case of the cold rolled specimens as a result of the nitrogen addition but that the thermal expansion coefficient, room temperature to 200° F. (93° C.), of the annealed samples of Alloy A and Examples 1-3 decreased a relatively small amount, from $16.84\times10^{-6}$/° F. ($30.31\times10^{-6}$/° C.) to $14.08\times10^{-6}$/° F. ($25.34\times10^{-6}$/° C.), as a result of the nitrogen additions. That decrease is offset by the improvement in other properties.

Strip 0.250 inch (6.35 mm) thick of Examples 1-3, 5 and Alloys A and B was cold rolled to 0.050 inch (1.27 mm) thick with an intermediate anneal. Duplicate tensile specimens and electrical resistivity samples were prepared, divided into two sets and tests were carried out on one set of test specimens in the cold rolled condition and, after the other set had been annealed at 1500° F. (815° C.) for ½ hour and air cooled, specimens were subjected to resistivity tests, the resulting data being tabulated in Table V. In the case of Examples 1-3, and Alloy A, room temperature tensile tests were carried out, the results being reported in Table VII where 0.2% yield strength in thousands of pounds per square inch (kilograms per square centimeter) is given under 0.2% YS (ksi) (kg/cm$^2$), ultimate tensile strength is given under UTS and percent elongation in 2 inches (5.08 cm) is given under %E1.

TABLE V

| | Resistivity, ohms cir mil/ft (microhms-cm) Cold Rolled 50% | 60% | Annealed |
|---|---|---|---|
| Ex. 1 | — | 915 (152) | 922 (153) |
| Ex. 2 | — | 950 (158) | 997 (166) |
| Ex. 3 | — | 993 (165) | 1010 (168) |
| Alloy A | — | 868 (144) | 871 (145) |
| Ex. 5 | 1082 (180) | — | 1035 (172) |
| Alloy B | 1025 (170) | — | 1013 (168) |

TABLE VI

| | Room Temperature Tensile Properties Cold Rolled (60%) 0.2%YS ksi (kg/cm$^2$) | UTS ksi (kg/cm$^2$) | %E1 | Annealed 0.2%YS ksi (kg/cm$^2$) | UTS ksi (kg/cm$^2$) | %E1 |
|---|---|---|---|---|---|---|
| Ex. 1 | 112.6 (7917) | 118.5 (8331) | 8.6 | 34.4 (2419) | 79.4 (5582) | 36.9 |
| Ex. 2 | 136.2 (9576) | 145.1 (10200) | 9.4 | 43.9 (3086) | 92.8 (6524) | 37.2 |
| Ex. 3 | 171.4 (12051) | 190.9 (13422) | 4.8 | 58.3 (4100) | 106.8 (7510) | 31.4 |
| Alloy A | 95.1 (6686) | 100.6 (7073) | 8.6 | 23.6 (1660) | 64.0 (4500) | 36.8 |

The hardness of specimens of Examples 1-3 and Alloy A in the forged condition and after being cold rolled to about 60% reduction are set out in Table VII.

For specimens of Example 4, the table contains the hardness in the cold rolled condition, with about 50% reduction and as annealed at 1600° F. (870° C.) for 10 minutes followed by cooling in air. For Example 5 and Alloy B, the hardness after annealing for ½ hour at 1500° F. (815° C.) is given. Hardnesses are on the Rockwell B (Rb) scale or on the Rockwell C (Rc) scale as indicated.

TABLE VII

| | Hardness (Rb) Cold Rolled (60%) | Cold Rolled (50%) | Forged | Annealed (150° F) | Annealed (160° f) |
|---|---|---|---|---|---|
| Ex. 1 | Rc 23 | — | Rb 69 | — | — |
| Ex. 2 | Rc 31 | — | Rb 79.5 | — | — |
| Ex. 3 | Rc 38 | — | Rb 85 | — | — |
| Alloy A | Rb 93 | — | Rb 50 | — | — |
| Ex. 4 | — | Rc 33 | — | — | Rb 91 |
| Ex. 5 | — | — | — | Rb 68 | — |
| Alloy B | — | — | — | Rb 47 | — |

It is to be noted that other specific compositions than those illustrated above will be apparent to those skilled in the art which will have desirable expansivity and/or resistivity combined with the improved strength characteristic of the present invention. Thus, another specific composition within the range of this invention is one having an intermediate level of expansivity containing about 75% manganese, about 15% nickel and about 10% copper.

From the foregoing, it is apparent that the essential elements in the composition of the present invention are the elements manganese, copper, nickel and nitrogen. Most importantly, nitrogen contributes to the strength of this composition both in the stressed condition as results from cold working and in the annealed condition with the improvement in the latter condition being substantially greater. Wrought, hot worked or otherwise formed bar, rod and strip formed of this composition have a wide variety of uses because of its advantageous properties. The annealed material provides such articles as temperature responsive control elements strong enough to be used in the annealed condition in which condition a significantly reduced tendency to stress corrosion cracking is expected in the media or environments in which cold worked material is highly susceptible to stress corrosion cracking. In some instances, it may be desirable to increase the effective length of the bimetal to make up for the relatively small reduction in expansivity resulting from the addition of nitrogen.

It is to be understood, therefore, that what is considered to be the contribution made by the present invention resides in the strengthening effect of the addition of controlled amounts of nitrogen to the wide range of manganese-copper-nickel alloys in which manganese is the predominant constituent whether or not additional elements are included. While it is preferred to avoid the presence of other elements, it is contemplated that other strengthening mechanisms including the precipitation of some nitride may also be used. Thus, one or more nitride formers such as titanium, vanadium, niobium, tantalum, hafnium and zirconium may be included for that purpose or to tie up excess nitrogen so long as the other desired properties, thermal expansivity and/or electrical resistivity, are not reduced below a tolerable level. To this end, no more than a combined amount of about 5% would be used. It is also contemplated that other elements may also be present, as for example, varying amounts of one or more of chromium, aluminum, iron, molybdenum, cobalt, boron and berylium. In the case of the elements carbon, silicon, phosphorus and sulfur, up to about 0.5% carbon and up to about 0.5% silicon may be present, and phosphorus and sulfur should be limited to no more than about 0.04%.

As was indicated in the case of nitrogen, it is not intended by indicating preferred or intermediate ranges that are desirable in accordance with this invention to thereby exclude the possibility of combining one or more preferred or intermediate ranges with one or more broad ranges of other elements. Further, by indicating a preferred or intermediate range for an element, it is not intended to preclude the use of one or more of those minima or maxima with the broad, maximum or minimum of any one or more of the remaining elements.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. A high thermal expansion and/or high electrical resistivity manganese alloy having high mechanical strength, in weight percent, comprising about

| | w/o |
|---|---|
| Copper | 5–30 |
| Nickel | 5–30 |
| Nitrogen | 0.1–1.0 |

the balance being at least about 65% to less than 85% manganese, and in which the nitrogen present is substantially in solid solution and strengthens the alloy.

2. The alloy set forth in claim 1 which contains at least about 0.25% nitrogen.

3. The alloy set forth in claim 1 which contains up to about 0.9% nitrogen.

4. The alloy set forth in claim 2 which contains up to about 0.9% nitrogen.

5. The alloy set forth in claim 2 which contains up to about 0.6% nitrogen.

6. The alloy set forth in claim 1 which contains at least about 0.5% nitrogen.

7. The alloy set forth in claim 3 which contains at least about 0.5% nitrogen.

8. The alloy set forth in claim 1 which contains up to about 82% manganese.

9. The alloy set forth in claim 8 in which the ratio of the copper-nickel contents is equal to or greater than 1 when the manganese content of the alloy is greater than about 75% and said ratio is less than 1 when the manganese content is less than about 75%.

10. The alloy set forth in claim 9 which contains at least about 0.25% nitrogen.

11. The alloy set forth in claim 9 which contains up to about 0.9% nitrogen.

12. The alloy set forth in claim 10 which contains up to about 0.9% nitrogen.

13. The alloy set forth in claim 10 which contains up to about 0.6% nitrogen.

14. The alloy set forth in claim 9 which contains at least about 0.5% nitrogen.

15. The alloy set forth in claim 12 which contains at least about 0.5% nitrogen.

16. The alloy set forth in claim 4 which contains about 80% manganese, about 10% nickel, and about 10% copper.

17. The alloy set forth in claim 5 which contains about 80% manganese, about 10% nickel, and about 10% copper.

18. The alloy set forth in claim 4 which contains about 75% manganese, about 15% nickel, and about 10% copper.

19. The alloy set forth in claim 4 which contains about 72% manganese, about 10% nickel and about 17% copper.

20. A shaped article made from the alloy of claim 1.

21. A shaped article made from the alloy of claim 4.

22. A temperature responsive article which includes an elongated member made from the alloy of claim 1.

23. A temperature responsive article which includes an elongated member made from the alloy of claim 4.

* * * * *

UNITED STATES PATENT OFFICE

CERTIFICATE OF CORRECTION

PATENT NO. : 4,131,457

DATED : December 26, 1978

INVENTOR(S) : Earl L. Frantz

It is certified that error appears in the above-identified patent and that said Letters Patent are hereby corrected as shown below:

Col. 1, line 14 for "device" read -- devices --

Col. 4, line 26 for "for" read -- from --

Col. 4, Table II, Example 1, second line for "(28.69" read -- (28.69) -- and for "31.45)" read -- (31.45) --

Col. 4, Table II, Example 5, first line for "4.28" read -- 14.28 --

Col. 5, Table VII, last 2 columns under annealed for "(150°F) (160°f) read -- (1500°F) (1600°F) --

Signed and Sealed this

*Thirty-first* Day of *July 1979*

[SEAL]

*Attest:*

*Attesting Officer*

LUTRELLE F. PARKER

*Acting Commissioner of Patents and Trademarks*